US005133189A

United States Patent [19]

Hurley

[11] Patent Number: 5,133,189

[45] Date of Patent: Jul. 28, 1992

[54] SYSTEM AND METHOD FOR INDIVIDUALLY TESTING VALVES IN A STEAM TURBINE TRIP CONTROL SYSTEM

[75] Inventor: Joseph D. Hurley, Casselberry, Fla.

[73] Assignee: Westinghouse Electric Corp., Pittsburgh, Pa.

[21] Appl. No.: 730,319

[22] Filed: Jul. 15, 1991

[51] Int. Cl.[5] ..... F01K 13/02

[52] U.S. Cl. ..... 60/646; 60/657

[58] Field of Search ..... 60/646, 657

[56] References Cited

U.S. PATENT DOCUMENTS 4,554,788 11/1985 Hwang et al. ..... 60/657

*Primary Examiner*—Allen M. Ostrager

[57] ABSTRACT

A system is provided for independently testing trip valves in a multi-valve electro-hydraulic trip control system for a steam turbine. The electro-hydraulic trip control system features first and second channels arranged in series to control the pressure of a hydraulic fluid supplied to the actuator of the steam turbine throttle valve. Each of the channels has first and second trip valves arranged in parallel. First and second orifices are arranged in parallel with the first and second channels, respectively. First and second pressure switches are adapted to sense the pressure in the hydraulic fluid downstream of the first orifice. A programmable controller is programmed to test each of trip valves individually by individually opening and closing each of the trip valves sequentially and determining whether the signals from the pressure switches indicate that the trip valve being tested has opened. The programmable controller is programmed to indicate a valve failure should one of the trip valves fail to open.

19 Claims, 3 Drawing Sheets

SYSTEM AND METHOD FOR INDIVIDUALLY TESTING VALVES IN A STEAM TURBINE TRIP CONTROL SYSTEM

FIELD OF THE INVENTION

The present invention relates generally to failure detection in the hydraulic control system of a steam turbine. More particularly, the present invention relates to a system and method for identifying the failure of an individual valve in a redundant valve electro-hydraulic trip control system.

BACKGROUND OF THE INVENTION

Steam turbine power plants typically employ electro-hydraulic control systems which perform a variety of functions, including tripping—that is, shutting down on an emergency basis—the turbine when certain conditions arise. Such conditions include those indicating imminent damage to the turbine—for example, low bearing oil pressure, rotor overspeed, and low control fluid pressure. In addition, it may be necessary to trip the turbine as a result of dangerous conditions in other components of the power plant, such as the steam generator, the operation of which is influenced by the turbine. Typically, the presence of such dangerous conditions are determined by various sensors distributed throughout the power plant. The output from these sensors is wired into the electro-hydraulic control system which initiates the trip.

Typically, steam turbines are tripped by closing the throttle valve which controls the introduction of high pressure steam to the turbine. Since it is important to close such valves as quickly as possible upon tripping, the throttle valve is spring loaded to close. As a result, pressure must be exerted by a hydraulic fluid on the valve actuator to keep the valve open. This hydraulic pressure is maintained in a closed loop system by a pump driven by the turbine. A trip is accomplished by opening trip valves in the closed loop system which divert the hydraulic fluid to a vented drain tank, thereby dropping the pressure to the throttle valve actuator so that the spring automatically closes the throttle valve.

According to the prior art, the aforementioned trip valves are arranged in a piping system collectively referred to as a "trip control block", shown in FIG. 1. There are four trip valves 15–18, each operated by a solenoid 23, and two orifices 19 and 20 in the trip control block. The valves are arranged into two "channels" 21 and 22. Channel 21 contains valves 15 and 16 and channel 22 contains valves 17 and 18. Valves 15 and 16 and orifice 19 are arranged in parallel. In addition, valves 17 and 18 and orifice 20 are arranged in parallel. However, valves 15 and 16 and orifice 19 are arranged in series with respect to valves 17 and !8 and orifice 20. A header 10 receives hydraulic fluid from the actuator of the throttle valve so that a decrease in pressure in the header 10 results in a turbine trip. Header 10 is connected via tubing to channel 21 and orifice 19. The output from channel 21 and orifice 19 is connected via tubing to channel 22 and orifice 20.

During normal operation, all of the trip valves 15–18 remain closed so that hydraulic fluid can flow from the header 10 to a vented drain 11 only by flowing through both orifices 19 and 20. Orifices 19 and 20 are sized so that the quantity of flow they permit is well within the capability of the hydraulic fluid pump, allowing the pump and throttle valve actuator to maintain adequate pressure in the header 10 to keep the throttle valve open.

According to the prior art, the logic for tripping the turbine was hard wired. When one of the aforementioned condition sensors sensed that a turbine trip condition had been satisfied, it sent a signal via conductors 33 and 34 to relays 35 and 36, respectively. In order to avoid excessive complexity in the control system, the output of relay 35 operates both valves 15 and 16 and the output of relay 36 operates both valves 17 and 18. Thus, at a turbine trip, all four trip valves 15–18 simultaneously opened. This caused the major portion of the hydraulic fluid to flow through the trip valves 15–18 directly to the drain 11, bypassing both orifices 19 and 20. The flow coefficient of each of the trip valves 15–18 is approximately 500 times larger than that of either of the orifices 19 and 20, resulting in a very large increase in flow through the trip control block. As a result, the pressure in the header 10 from the throttle valve actuator 6 drops and the throttle valve closes, thereby tripping the turbine.

Although relays 35 and 36 direct both valves in their respective channels 21 and 22 to open simultaneously, since the valves within each channel are arranged in parallel, only one valve from each channel need be opened to cause a turbine trip. Moreover, since the channels 21 and 22 are arranged in series with respect to each other, at least one valve from each channel must be opened to cause a trip. As a result of this redundancy, the failure of any one valve in the open position will not cause an unintended turbine trip, nor will the failure of any one valve in the closed position prevent a turbine trip from being initiated. Such redundancy is important since failure to trip the turbine when appropriate could result in extensive damage to the power plant and an unintended trip of the turbine results in troublesome power disruptions.

Redundancy notwithstanding, due to the importance of proper trip valve functioning, the trip valves 15–18 are frequently tested. Since turbines are typically required to operate for long periods of time without interruption, such testing includes testing while the turbine is operating. Fortunately, since a trip will not occur unless one valve from each channel is opened, each channel can be tested separately without danger of causing an accidental trip. Accordingly, pressure switches 13 and 14 are incorporated into the trip control block downstream of orifice 19. Switch 13 closes when the pressure in the header 10 increases above a predetermined value and pressure switch 14 closes when the pressure in the header 10 decreases below a predetermined value.

According to the prior art, channel 21 is tested by actuating relay 35 and then sensing whether pressure switch 13 has closed. The opening of either valves 15 or 16 in channel 21 will cause the flow through the trip control block to bypass orifice 19 and flow through only orifice 20. As a result, the flow and, therefore, the pressure drop, across orifice 19 will decrease, thereby increasing the pressure at switch 13, causing it to close. Similarly, channel 22 is tested by actuating relay 36 and then sensing whether pressure switch 14 has closed. The opening of either valves 17 or 18 in channel 22 will cause the flow through the trip control block to bypass orifice 20 and flow through only orifice 19. As a result, the flow and; therefore, the pressure drop, across orifice 20 will decrease, thereby decreasing the pressure at switch 14, causing it to close.

Unfortunately, since, as explained above, the valve logic according to the prior art precludes operating the valves in any one channel independently, it is impossible to determine whether one valve in a channel has failed in the closed position. This is so because even if one valve in a channel has failed closed, the opening of the other valve will cause a sufficient change in pressure to actuate the pressure switch, thereby masking the failure of one valve to open. This can lead to a dangerous situation since if there has been an undetected failure of one valve in the closed position, the subsequent failure of the single previously working valve in that channel will result in an inability to trip the turbine. Unfortunately, under the hard wired logic approach of the prior art, independent operation of the valves in each channel could only be obtained by doubling the number of relays, so that each relay operated only one valve, and increasing the complexity of the logic circuits. This results in an unacceptable increase in the complexity of the control system.

Accordingly, it would be desirable to provide a system and method for testing each valve in each channel independently without introducing excessive complexity into the control system.

SUMMARY OF THE INVENTION

It is the object of the current invention to provide a system and method which allows each valve in a redundant hydraulic trip control system to be individually tested.

This object is accomplished in a steam turbine power plant having (i) a steam generator, (ii) a steam turbine adapted to receive steam from the steam generator, (iii) a throttle valve for regulating the flow of the steam received by the steam turbine, and (iv) an electro-hydraulic control system for causing the throttle valve to close when a predetermined condition has been reached. The control system has (i) at least four valves for regulating the flow of a hydraulic fluid within the control system, (ii) first and second orifices, (iii) first and second pressure sensors, and (iv) a programmable controller having logic for independently testing each of the valves. The four valves are arranged in first and second pairs. The first pair of valves are arranged in parallel and the second pair of valves are arranged in parallel, while the first valve pair is arranged in series with respect to the second valve pair. The first orifice is arranged in parallel with respect to the first valve pair, whereby the first orifice allows a predetermined portion of hydraulic fluid to bypass the first valve pair. The second orifice is arranged in parallel with respect to the second valve pair, whereby the second orifice allows a predetermined portion of hydraulic fluid to bypass the second valve pair. The first pressure sensor is adapted to detect an increase in the pressure in the hydraulic fluid downstream of the first orifice and the second pressure sensor is adapted to detect a decrease in the pressure in the hydraulic fluid downstream of the first orifice. Moreover, the first and second pressure sensors are disposed downstream of the first orifice and adapted to transmit signals indicative of whether they have detected a pressure increase or decrease to the programmable controller. The programmable controller is programmed with logic for (i) detecting the signals from the first and second pressure sensors and determining whether these signals indicate that the pressure has increased or decreased, (ii) directing only one valve to open, and (iii) indicating a failure of that valve if the first pressure sensor exceeds the first predetermined value after the valve has been directed to open.

BRIEF DESCRIPTION OF THE DRAWINGS

The invention will become more readily apparent from the following description of a preferred embodiment thereof shown, by way of example only, in the accompanying drawings wherein.

DESCRIPTION OF THE PREFERRED EMBODIMENT

Figure 1:
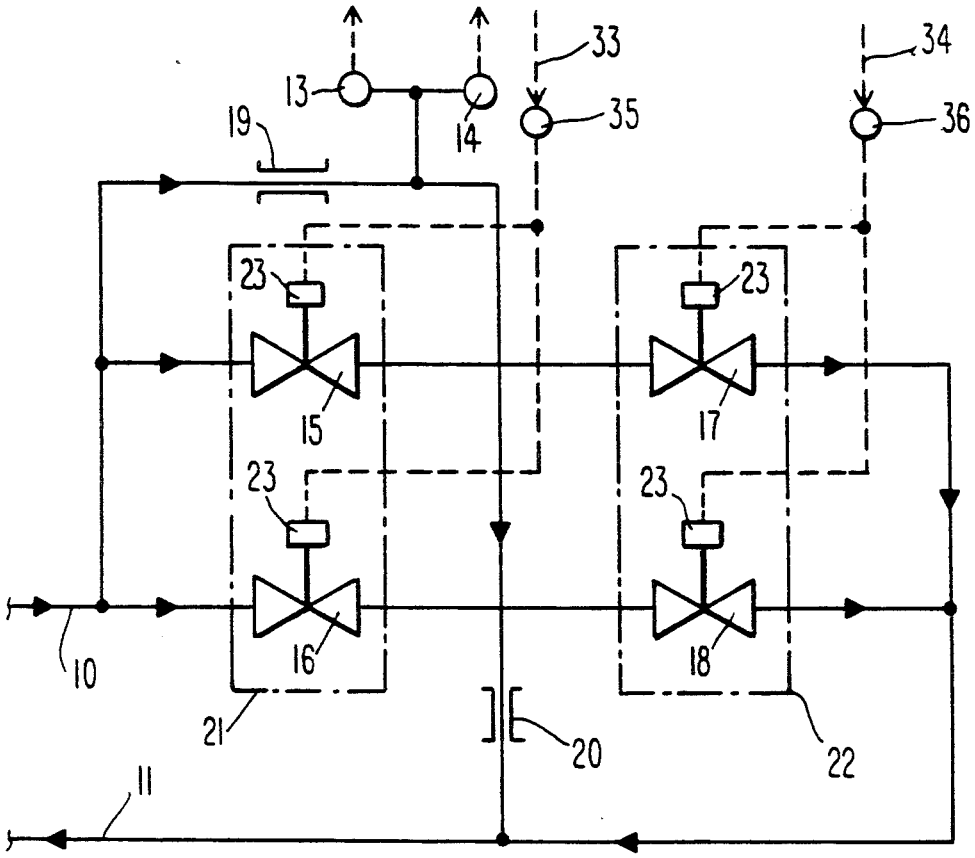
Fig. 1 PRIOR ART
FIG. 1 is a schematic diagram of a portion of the electro-hydraulic trip control system according to the prior art.
Figure 2:
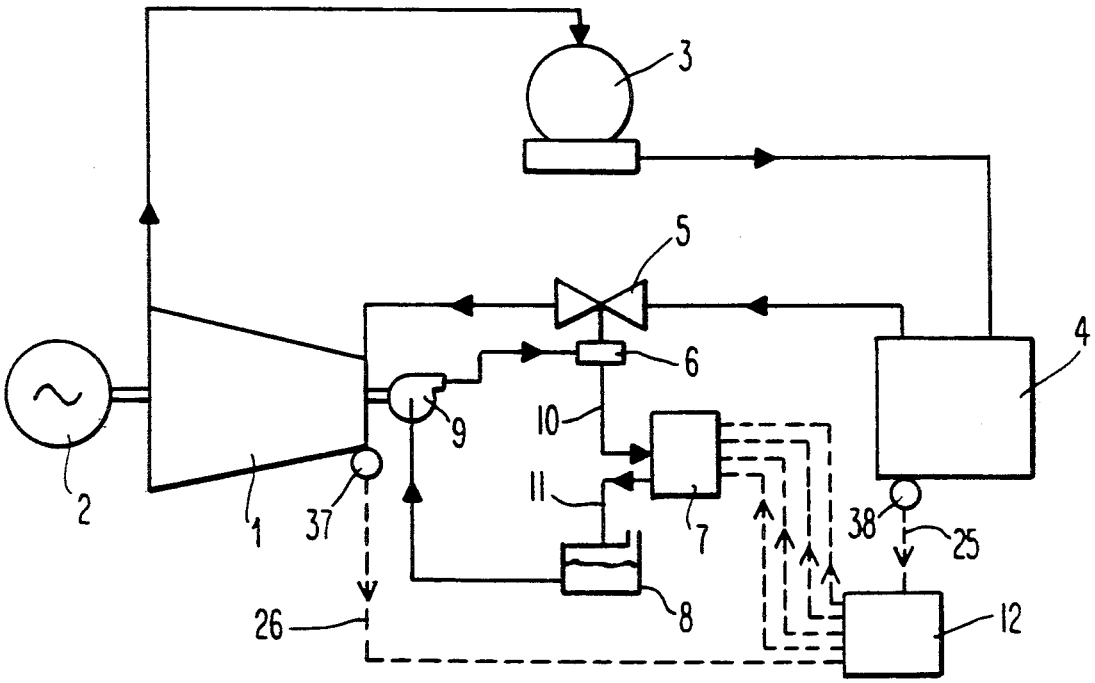
FIG. 2 is a schematic diagram of a steam turbine power plant showing the electro-hydraulic trip control system according to the current invention.

Referring to the drawings, wherein like numerals represent like elements, there is illustrated in FIG. 2, a steam turbine power plant. The major components of the power plant include a steam turbine 1, an electrical generator 2, a condenser 3 and a steam generator 4. The steam generator 4 converts feedwater from the condenser 3 to steam. The steam is directed to the steam turbine 1 which extracts energy therefrom to drive the electrical generator 2 and then exhausts the steam to the condenser 3.

Figure 3:
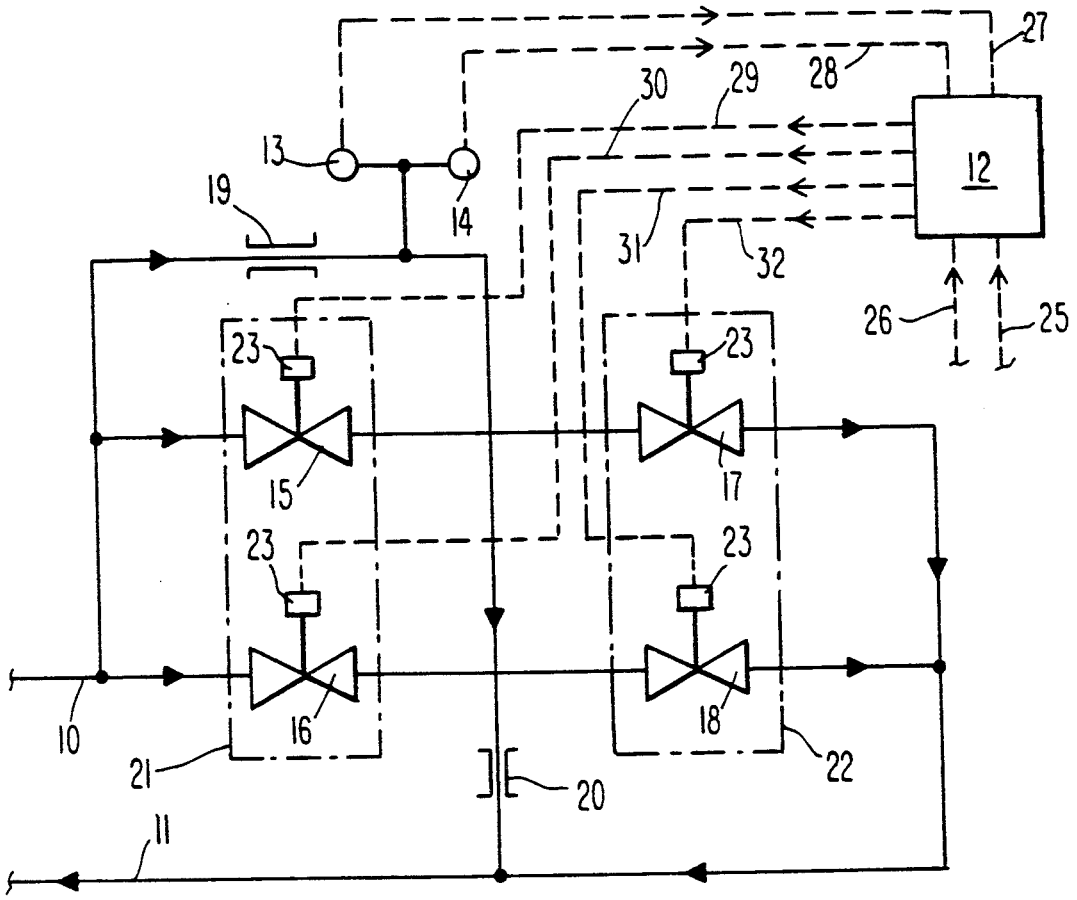
FIG. 3 is a schematic diagram of the electro-hydraulic trip control system shown in FIG. 2.

The flow of steam to the turbine is regulated by a throttle valve 5. As is conventional, the throttle valve 5 is operated by a hydraulic actuator 6 supplied with pressurized hydraulic fluid from an electro-hydraulic control , system. The electro-hydraulic control system is comprised of a pump 9, header 10, drain 11, tank 8 and trip control block 7, all arranged in a closed loop system, and a programmable controller 12. The pump 9 draws hydraulic fluid from the vented tank 8 and directs it to the throttle valve actuator 6. As previously discussed, the flow of fluid through the throttle valve actuator 6 in the closed loop hydraulic system is controlled by the trip control valves 15–18 arranged in the trip control block 7, as shown in FIG. 3. According to the current invention, the operation of the trip valves 15–18 is controlled by a programmable controller 12, rather than the relays heretofore used in the prior art as previously explained.

As shown in FIGS. 2 and 3, the programmable controller 7 receives signals via conductors 25 and 26 from condition monitoring sensors 37 and 38 located in the turbine 1 and steam generator 4, respectively. Although inputs from only two sensors 37 and 38 are shown for simplicity, it should be understood that in actual practice the programmable controller 12 will process signals from a variety of sensors located at various locations within the turbine 1.

Figure 5:
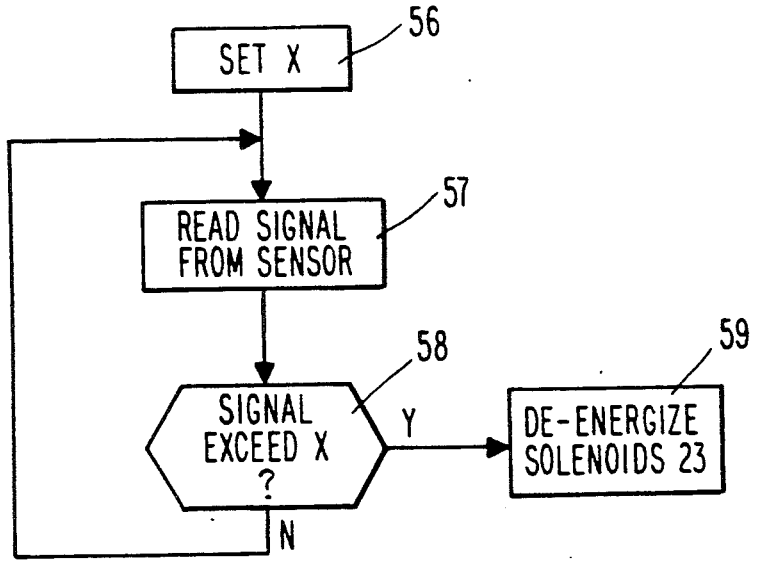
FIG. 5 shows logic steps programmed into the programmable controller.

The controller 12, using means well known in the art, compares the signals received from the sensors 37 and 38 to predetermined trip values stored within the controller—for example by using the logic shown in FIG. 5. Since during normal operation the sensor signals are below the trip values, the controller 12 does not de-energize the solenoids 23 and the trip valves 15–18 remain closed. As previously discussed, when the trip valves 15–18 are closed, the hydraulic fluid circulated by the pump 9 through the closed loop hydraulic system must flow through both orifices 19 and 20. Due to the small size of these orifices, the circulating flow is well within the capability of the pump 9 and the throttle valve actuator 6 to maintain sufficient pressure on the actuator to keep the throttle valve 5 open.

Upon receiving a signal from one of the sensors 37 or 38 which exceeds the predetermined trip value stored in the controller 12, the controller simultaneously de-energizes the solenoids 23 on each of the trip valves 15–18 via conductors 29–32, causing them to open and allowing the flow from the header 10 to go directly to the drain 11, bypassing the orifices 19 and 20. As previously discussed, the flow coefficient of the trip valves 15–18 is much greater than that of the orifices 19 and 20 and exceeds the capability of the pump 9 and the throttle valve actuator 6 to maintain sufficient pressure in the header 10 to keep the throttle valve 5 open. Thus, the programmable controller 12 replaces the relay logic previously used to open the trip valves 15–18 and cause the turbine to trip.

Figure 4:
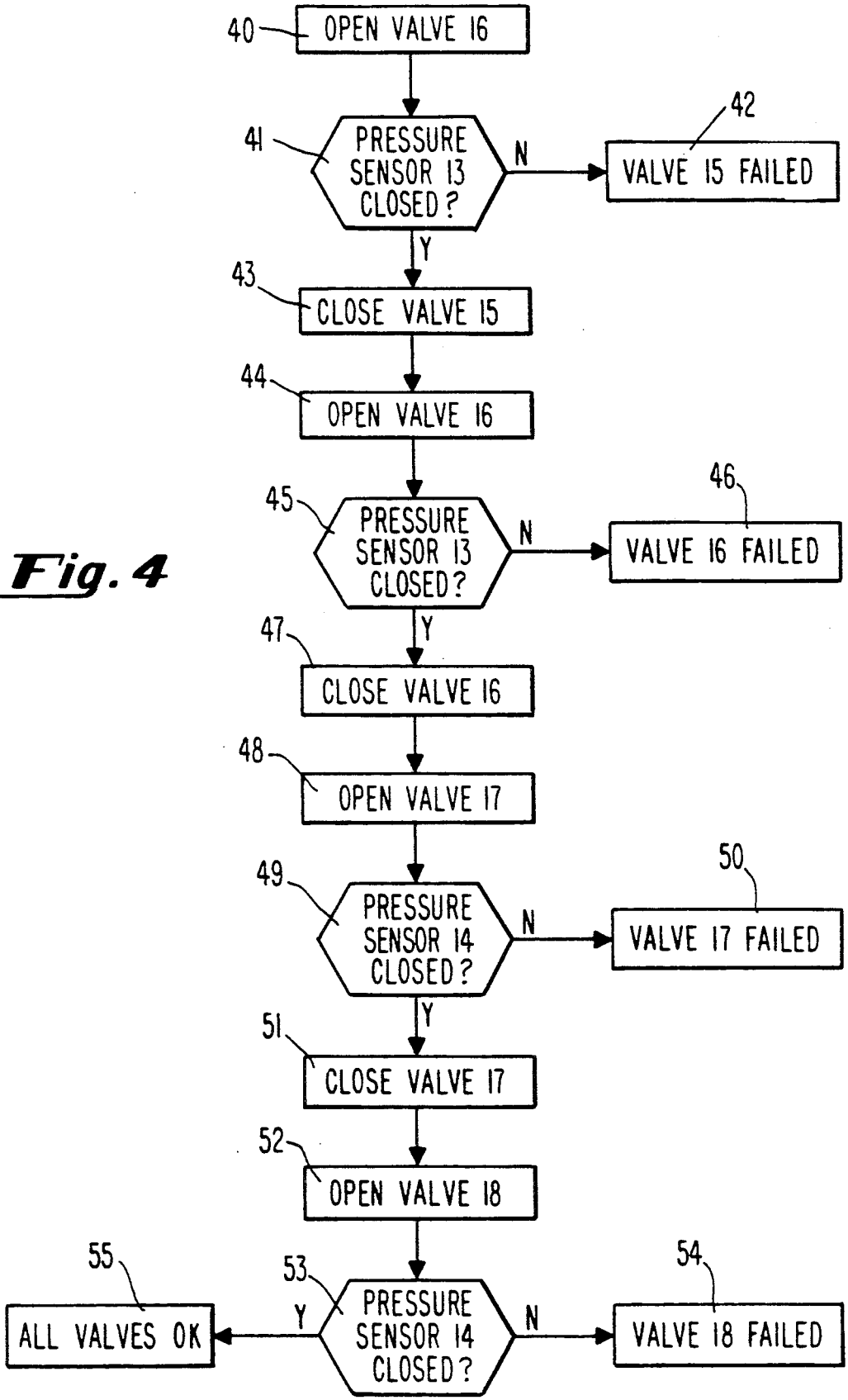
FIG. 4 is a flowchart illustrating the steps, which are programmed into the programmable controller shown in FIG. 3, of the method of testing for individual valve failure in the electro-hydraulic trip control system shown in FIG. 3.

Since, according to the current invention, the trip valves 15–18 are individually operated by the controller 12, each trip valve can be individually tested without adding complexity to the control system. Thus, according to the current invention, the proper functioning of the valves in the trip control block 7 can be individually tested, while the turbine 1 is operating, by the following method. Referring to FIG. 4, the test is initiated in step 40 by causing the controller 12 to send a signal via conductor 29 to de-energize the solenoid 23 of trip valve 15. Unless valve 15 has failed in the closed position, this action will cause the valve to open, thereby allowing the flow in the header 10 to bypass orifice 19. As previously discussed, upon opening valve 15, the pressure downstream of orifice 19 will increase above a predetermined level, thereby causing pressure switch 13 to close. As shown in FIG. 3, the signals from pressure switches 13 and 14 are directed, via conductors 27 and 28, to the controller 12. In step 41, the controller 12 determines whether or not valve 15 has failed by detecting, using means well known in the art, the state of the pressure switch 13. Should the controller 12 detect that the pressure switch 13 has not closed, indicating that the trip valve 15 has not opened, the controller is programmed to notify the operator accordingly—for example by a fault alarm—in step 42.

Next, in step 43, the controller 12 energizes the solenoid of valve 15, causing it to close. In step 44, the controller 12 causes valve 16 to open. Since the opening of valve 16 should have the same effect as the opening of valve 15, in steps 45 and 46 the controller determines whether switch 13 has closed and indicates a valve 16 failure if it has not.

In steps 47 and 48, the controller closes valve 16 and then opens valve 17. As previously discussed, the opening of valve 17 will cause the flow in the header 10 to bypass orifice 20, thereby causing the pressure downstream of orifice 19 to decrease. Thus, in step 49, the controller 12 compares the signal from switch 14 to a predetermined logic value to determines if the switch has closed and, in step 50, indicates that valve 17 has failed if the switch 14 has not closed.

In step 51 the controller 12 closes valve 17 and then tests valve 18 in a similar fashion in steps 52–54. If no valve failure has been detected, the controller indicate such in step 55.

Although the method for valve testing discussed above can be performed by manually directing controller 12 in a step wise fashion, according to the current invention, the controller 12 can be programmed to automatically sequence through steps 40–55 upon a single start command. Alternatively, using techniques well known in the art, the controller could be programmed to periodically automatically execute steps 40–55 on its own initiative, thereby completely automating the trip valve testing method.

The present invention may be embodied in other specific forms without departing from the spirit or essential attributes of the invention, and accordingly, reference should be made to the following claims rather to the foregoing specification, as indicating the scope of the invention.

I claim:

1. A steam turbine power plant, comprising:
   a) a steam generator;
   b) a steam turbine adapted to receive steam from said steam generator;
   c) a throttle valve for regulating the flow of said steam received by said steam turbine; and
   d) an electro-hydraulic trip control system for causing said throttle valve to close when a predetermined condition has been reached, said control system having:
      (i) at least four valves for regulating the flow of a hydraulic fluid within said control system; and
      (ii) a programmable controller having logic for independently testing each of said valves.

2. The steam turbine power plant according to claim 1, wherein said throttle valve has an actuator adapted to receive hydraulic fluid and to close said throttle valve if the pressure of said hydraulic fluid drops below a predetermined value, said four valves in hydraulic flow communication with said actuator.

3. The steam turbine power plant according to claim 2, wherein said four valves are arranged in first and second pairs, said first pair of valves arranged in parallel and said second pair of valves arranged in parallel, said first valve pair arranged in series with respect to said second valve pair, whereby the opening of at least one of said valves in said first valve pair combined with the opening of at least one of said valves in said second valve pair causes the pressure of said hydraulic fluid to drop below said predetermined value but the opening of any one of said valves alone does not cause the pressure of said hydraulic fluid to drop below said predetermined value.

4. The steam turbine power plant according to claim 3, further comprising:
   a) a sensor adapted to transmit a signal indicative of a condition in said steam turbine; and
   b) means for directing said sensor signal to said programmable controller.

5. The steam turbine power plant according to claim 4, wherein said programmable controller is programmed with logic for comparing said sensor signal to a predetermined value.

6. The steam turbine power plant according to claim 5, wherein said programmable controller has means for independently causing each of said values to open when said sensor signal reaches said predetermined value.

7. The steam turbine power plant according to claim 6, wherein said programmable controller has means for causing only a first one of said valves to open during a test procedure.

8. The steam turbine power plant according to claim 3, wherein said control system further comprises first and second orifices, said first orifice arranged in parallel with respect to said first valve pair, whereby said first orifice allows a predetermined portion of said hydraulic fluid to bypass said first valve pair, said second orifice arranged in parallel with respect to said second valve pair, whereby said second orifice allows a predetermined portion of said hydraulic fluid to bypass said second valve pair.

9. The steam turbine power plant according to claim 8, wherein said control system further comprises first and second pressure sensors, said first pressure sensor adapted to detect an increase in the pressure in said hydraulic fluid downstream of said first orifice, said second pressure sensor adapted to detect a decrease in the pressure in said hydraulic fluid downstream of said first orifice.

10. The steam turbine power plant according to claim 9, wherein said first and second pressure sensors are adapted to transmit signals indicative of whether said first and second pressure sensors have detected said pressure increase and decrease, respectively, and further comprising means for directing said signals to said programmable controller.

11. The steam turbine power plant according to claim 10, wherein said programmable controller is adapted to receive said signals from said first and second pressure sensors and to determine from said signals whether said first and second pressure sensors have detected said pressure increase and decrease, respectively.

12. The steam turbine power plant according to claim 11, wherein said programmable controller is programmed with logic for:

a) directing each of said valves in said first valve pair to open individually while maintaining the other valve in said first valve pair and said second valve pair closed; and b) indicating a failure of said value so directed if said controller determines said first pressure sensor has not detected said pressure increase after said valve has been directed to open.

13. The steam turbine power plant according to claim 12, wherein said programmable controller is programmed with logic for:

a) directing each of said valves in said second valve pair to open individually while maintaining the other valve in said second valve pair and said first valve pair closed; and b) indicating a failure of said value so directed if said controller determines said second pressure sensor has not detected said pressure decrease after said valve has been directed to open.

14. A steam turbine power plant, comprising:

a) a steam turbine adapted to receive steam flow;

b) a control valve adapted to regulate the flow of said steam received by said steam turbine, said control valve having an actuator actuated by hydraulic fluid;

c) a trip control system for said control valve having:

(i) first and second trip valves and a first orifice, each adapted to control the flow of said hydraulic fluid, each arranged in parallel with respect to the others;

(ii) first and second pressure sensors adapted to sense the pressure of said hydraulic fluid downstream of said first orifice and to transmit a signal indicative of said pressure sensed;

(iii) second and third trip valves and a second orifice, each adapted to control the flow of said hydraulic fluid, each arranged in parallel with respect to the others and arranged in series with respect to said first and second trip valves and said first orifice; and d) a programmable controller for testing the operation of said trip valves, said programmable controller having:

(i) means for directing a test signal to open each of said trip valves independently;

(ii) means for receiving said signals from said pressure sensors; and (iii) means for determining whether said trip valve to which said test signal was directed has opened by sensing said signals received from said pressure sensors.

15. In a steam turbine power plant having a steam turbine electro-hydraulic trip control system having (i) first and second trip valves and a first orifice, each adapted to control the flow of a hydraulic fluid, each arranged in parallel with respect to the others, (ii) second and third trip valves and a second orifice, each adapted to control the flow of said hydraulic fluid, each arranged in parallel with respect to the others and arranged in series with respect to said first and second trip valves and said first orifice; a method for testing each of said trip valves independently while said turbine is operating, comprising the steps of:

a) sending a test signal only to said first trip valve;

b) sensing the pressure in said hydraulic fluid;

c) determining whether said pressure sensed has reached a predetermined value; and d) indicating a first trip valve failure if said pressure has not reached said predetermined value.

16. The method according to claim 15, further comprising the steps of repeating steps (a) through (d) for said second trip valve, then for said third trip valve and then for said fourth trip valve.

17. The method according to claim 15, wherein steps (a), (c) and (d) are performed by a programmable controller.

18. The method according to claim 16, wherein steps (a), (c) and (d) are automatically performed for each of said trip values periodically by a programmable controller.

19. The method according to claim 15, wherein the step of sensing said pressure comprises the step of sensing said pressure at a location downstream of said first orifice and upstream of said second orifice.

* * * * *